US009944072B2

(12) United States Patent
Tamura et al.

(10) Patent No.: US 9,944,072 B2
(45) Date of Patent: Apr. 17, 2018

(54) LIQUID DISHCARGING APPARATUS, CONTROLLER, AND HEAD UNIT

(71) Applicant: SEIKO EPSON CORPORATION, Tokyo (JP)

(72) Inventors: Noboru Tamura, Nagano (JP); Toru Matsuyama, Nagano (JP); Ryo Hirabayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/622,304

(22) Filed: Jun. 14, 2017

(65) Prior Publication Data

US 2018/0009218 A1 Jan. 11, 2018

(30) Foreign Application Priority Data

Jul. 6, 2016 (JP) ..... 2016-134374

(51) Int. Cl.
*B41J 2/045* (2006.01)

(52) U.S. Cl.
CPC ..... *B41J 2/04541* (2013.01); *B41J 2/04581* (2013.01); *B41J 2/04586* (2013.01); *B41J 2/04588* (2013.01)

(58) Field of Classification Search
CPC ..... B41J 2/04541; B41J 2/04586; B41J 2/04581; B41J 2/04588
See application file for complete search history.

(56) References Cited

U.S. PATENT DOCUMENTS 6,726,298 B2 4/2004 Anderson et al.
8,430,463 B2 * 4/2013 Kwak ..... G06K 15/00 347/5

FOREIGN PATENT DOCUMENTS

JP 2002-326348 A 11/2002

* cited by examiner

*Primary Examiner* — Sharon A Polk

(57) ABSTRACT

A liquid discharging apparatus includes a head unit which includes a discharge unit which discharges a liquid, a controller which controls discharging of the liquid, a plurality of first signal lines which connect the controller to the head unit, and at least one second signal line which connects the controller to the head unit, in which, the controller transmits the differential signal to the head unit via the first signal lines, and in which the head unit transmits the state signal in analog format to the controller via the second signal line.

7 Claims, 9 Drawing Sheets

| (SIH, SIM, SIL) | | T1 | | | T2 | | |
|---|---|---|---|---|---|---|---|
| | | Sa | Sb | Sc | Sa | Sb | Sc |
| (1, 1, 0) | [LARGE DOT] | H | L | L | H | L | L |
| (1, 0, 0) | [MEDIUM DOT] | H | L | L | L | H | L |
| (0, 1, 0) | [SMALL DOT] | L | L | L | L | H | L |
| (0, 0, 0) | [NON-RECORDING] | L | H | L | L | L | L |
| (0, 0, 1) | [INSPECTION] | L | L | H | L | L | H |

LIQUID DISHCARGING APPARATUS, CONTROLLER, AND HEAD UNIT

BACKGROUND

1. Technical Field

The present invention relates to a liquid discharging apparatus, a controller, and a head unit.

2. Related Art

Of liquid discharging apparatuses such as ink jet printers which print images and documents by discharging an ink, there is known a liquid discharging apparatus which uses piezoelectric elements (for example, a piezo element). The piezoelectric elements are provided to correspond to each of a plurality of discharge units in a head (an ink jet head), and due to each of the piezoelectric elements being driven according to a drive signal, a predetermined amount of the ink (a liquid) is discharged from nozzles of the discharge units at a predetermined timing to form dots. In a liquid discharging apparatus such as a printer, various control signals for driving the discharge units are generated by a controller on the main body side, and are transmitted to a head unit on which the head is installed. In recent years, there is a demand for an increase in nozzle density, and the data amount of the control signals is increasing, and thus, high speed signal transfer between the controller and the head unit is becoming necessary.

In JP-A-2002-326348, a printer is proposed which realizes high speed transfer by performing bidirectional signal transfer between the controller and the head unit using an LVDS transfer system.

However, in a case in which the signal transfer between the controller on the main body side and the head unit is performed using the LVDS transfer system as in the printer described in JP-A-2002-326348, when a signal indicating the state of the head unit which is detected as an analog signal is converted into a signal of the LVDS system in order to transmit the signal to the controller, the accuracy of the signal is reduced, and as a result, the discharge accuracy may be reduced.

SUMMARY

An advantage of some aspects of the invention is to provide a liquid discharging apparatus capable of performing processing at high speed with high accuracy. Another aspect of some aspects of the invention is to provide a controller and a head unit capable of being used in a liquid discharging apparatus which performs processing at high speed with high accuracy.

The invention can be, realized in the following aspects or application examples.

Application Example 1

According to this application example, there is provided a liquid discharging apparatus which includes a head unit which includes a discharge unit which discharges a liquid, a controller which controls discharging of the liquid, a plurality of first signal lines which connect the controller to the head unit, and at least one second signal line which connects the controller to the head unit, in which, the controller includes a control signal generation unit which generates a plurality of types of original control signal for controlling discharging of the liquid, a control signal conversion unit which converts the plurality of types of original control signal into one serial format serial control signal, a control signal transmission unit which converts the serial control signal into a differential signal, and transmitting the differential signal to the head unit via the first signal lines, a state signal reception unit which receives a state signal indicating a state of the head unit which is transmitted from the head unit via the second signal line, and a state determination unit which determines a state of the discharge unit based on the state signal which is received, and in which the head unit includes a control signal reception unit which receives the differential signal which is transmitted from the controller via the first signal lines and converting the differential signal which is received into the serial control signal, a control signal reconstruction unit which generates a plurality of types of control signal for controlling discharging of the liquid based on the serial control signal which is converted by the control signal reception unit, a state signal generation unit for detecting a state of the head unit to generate the state signal, and a state signal transmission unit which transmits the state signal in analog format to the controller via the second signal line.

In the liquid discharging apparatus according to this application example, the controller transmits a plurality of types of original control signal to the head unit as differential signals which are not easily influenced by common mode noise and capable of being subjected to low amplitude and high speed transfer. In other words, according to the liquid discharging apparatus of this application example, since it is possible to transfer a signal for controlling the discharging of the liquid from the controller to the head unit at high speed, even if the number of the discharge units of the head unit is large, it is possible to perform the process at high speed.

In the liquid discharging apparatus according to this application example, since the head unit transmits the state signal indicating the state of the head unit itself to the controller still in the analog signal state without converting the state signal into a differential signal, there is no reduction in the signal accuracy which may occur when converting the state signal to a differential signal. The controller is capable of accurately determining the state of the head unit based on the high-accuracy state signal which is transmitted from the head unit. Therefore, according to the liquid discharging apparatus according to this application example, since it is possible to suppress the reduction in the discharge accuracy of the liquid from the discharge unit based on the accurate determination results of the state of the head unit, it is possible to accurately perform the process.

In the liquid discharging apparatus according to this application example, the controller converts the plurality of types of original control signal to one serial control signal and transmits the serial control signal to the head unit, and the head unit transmits the state signal to the controller as an analog signal which can be transferred using one signal line without using the differential signal which requires two signal lines for the transfer. Therefore, according to the liquid discharging apparatus according to this application example, since it is possible to reduce the number of signal lines which are necessary for the transfer of the signal, it is possible to reduce costs.

Application Example 2

In the liquid discharging apparatus according to the application example, the discharge unit may be driven based on a drive signal, and the state signal generation unit may detect residual vibration of the discharge unit after the discharge unit is driven, and generate a residual vibration signal indicating the residual vibration as one of the state signals.

There is a case in which the liquid is not normally discharged from the discharge unit as a result of the mixing in of bubbles in the discharge unit, an increase in the viscosity or the adherence of the liquid due to drying or the like, adherence of foreign matter such as paper dust to the vicinity of the discharge port (the nozzle) of the liquid, or the like, and it is possible to determine the presence or absence of these discharge faults by analyzing the frequency and the attenuation rate of the amplitude of the residual vibration which is generated after the discharge unit is driven by the drive signal. According to the liquid discharging apparatus according to this application example, the controller determines the presence or absence of the discharge faults based on the residual vibration signal indicating the residual vibrations of the discharge unit which is transmitted from the head unit, and is capable of suppressing a reduction in the discharge accuracy by performing an appropriate process based on the determination results.

Application Example 3

In the liquid discharging apparatus according to the application example, the state signal generation unit may detect a temperature of the head unit, and may generate a temperature signal indicating the temperature as one of the state signals.

In the liquid discharging apparatus according to this application example, when the temperature of the head unit changes, the discharge characteristics of the discharge unit change, and the discharge accuracy of the liquid from the discharge unit is influenced. Therefore, according to the liquid discharging apparatus according to this application example, the controller accurately determines the state of the head unit based on the temperature signal indicating the temperature of the head unit which is transmitted from the head unit, and is capable of suppressing a reduction in the discharge accuracy by performing an appropriate process based on the determination results.

Application Example 4

The liquid discharging apparatus according to the application example may further include a third signal line, in which the controller may further include a drive data generation unit which generates original drive data which is data indicating a drive signal for driving the discharge unit, and a drive data transmission unit which transmits the original drive data to the head unit via the third signal line, and in which the head unit may further include a drive data reception unit which receives the original drive data which is transmitted from the controller, and outputting drive data which is data indicating the drive signal, and a drive circuit which generates the drive signal based on the drive data.

In the liquid discharging apparatus according to this application example, the controller transmits the original drive data to the head unit, and a drive circuit which is provided in the head unit generates the drive signal for driving the discharge unit based on the original drive data. In other words, according to the liquid discharging apparatus according to this application example, since the controller does not transmit the drive signal, which drives the discharge unit, itself to the head unit, distortion (such as overshoot) of the waveform due to the drive signal being transferred via the long signal line does not occur, and it is possible to increase the discharge accuracy.

Application Example 5

The liquid discharging apparatus according to the application example may further include a third signal line, in which the controller may further include a drive data generation unit which generates original drive data which is data indicating a drive signal for driving the discharge unit, and a drive data transmission unit which transmits the original drive data to the head unit via the third signal line, in which the head unit may further include a drive data reception unit which receives the original drive data which is transmitted from the controller, and outputting drive data which is data indicating the drive signal, and a drive circuit which generates the drive signal based on the drive data, and in which the state signal generation unit may detect a temperature of the drive circuit and generate a temperature signal indicating the temperature as one of the state signals.

In the liquid discharging apparatus according to this application example, the drive signal for driving the discharge unit is a high voltage (several ten V) signal, the power consumption of the drive circuit which generates the drive signal is great and easily becomes a high temperature, and when the waveform of the drive signal changes in accordance with the temperature characteristics of the drive circuit, the discharge accuracy of the liquid from the discharge unit is influenced. Therefore, according to the liquid discharging apparatus according to this application example, the controller accurately determines the state of the head unit based on the temperature signal indicating the temperature of the drive circuit which is transmitted from the head unit, and is capable of suppressing a reduction in the discharge accuracy of the liquid from the discharge unit based on the determination results.

Application Example 6

According to this application example, there is provided a controller which is connected by a plurality of first signal lines and at least one second signal line to a head unit including a discharge unit which discharges a liquid, the controller including a control signal generation unit which generates a plurality of types of original control signal for controlling discharging of the liquid, a control signal conversion unit which converts the plurality of types of original control signal into one serial format serial control signal, a control signal transmission unit which converts the serial control signal into a differential signal, and transmitting the differential signal to the head unit via the first signal lines, a state signal reception unit for receiving a state signal indicating a state of the head unit which is transmitted in analog format from the head unit via the second signal line, and a state determination unit which determines a state of the discharge unit based on the state signal which is received.

The controller according to this application example transmits a plurality of types of original control signal to the head unit as differential signals which are not easily influenced by common mode noise and capable of being subjected to low amplitude and high speed transfer. In other words, by using the controller according to this application example, since it is possible to transfer a signal for controlling the discharging of the liquid from the controller to the head unit at high speed, even if the number of the discharge units of the head unit is large, it is possible to realize a liquid discharging apparatus capable of performing the process at high speed.

In the controller according to this application example, since the state signal indicating the state of the head unit which is transmitted from the head unit is still in the analog signal state without being converted into a differential signal, there is no reduction in the signal accuracy which may occur when converting the differential signal. Therefore, the controller according to this application example is capable of accurately determining the state of the head unit based on the high-accuracy state signal, and suppressing a reduction in the discharge accuracy of the liquid from the discharge unit of the head unit based on the determination results. Therefore, by using the controller according to this application example, it is possible to realize a liquid discharging apparatus which is capable of accurately performing the process.

In the controller according to this application example, the plurality of types of original control signal are converted to one serial control signal and transmitted to the head unit, and the state signal which is transmitted from the head unit is an analog signal which can be transferred using one signal line without using the differential signal which requires two signal lines for the transfer. Therefore, since the liquid discharging apparatus which uses the controller according to this application example is capable of reducing the number of signal lines which are necessary for the transfer of the signal, it is possible to reduce costs.

Application Example 7

According to this application example, there is provided a head unit which is connected by a plurality of first signal lines and at least one second signal line to a controller, the head unit including a discharge unit which discharges a liquid, a control signal reception unit which receives a differential signal which is transmitted from the controller via the first signal lines and converting the differential signal which is received into one serial format serial control signal, a control signal reconstruction unit which generates a plurality of types of control signal for controlling discharging of the liquid based on the serial control signal which is converted by the control signal reception unit, a state signal generation unit which detects a state of the head unit to generate a state signal indicating the state of the head unit, and a state signal transmission unit which transmits the state signal in analog format to the controller via the second signal line.

Since the head unit according to this application example generates the plurality of types of control signal for controlling the discharging of the liquid from the differential signal which is transmitted as a differential signal which is not easily influenced by common mode noise and is capable of low amplitude and high speed transfer, it is possible to perform a high speed process even if the number of the discharge units is large. Therefore, by using the head unit according to this application example, it is possible to realize a liquid discharging apparatus which is capable of performing the process at high speed even if the number of the discharge units is large.

Since the head unit according to this application example transmits the state signal indicating the state of the head unit itself to the controller still in the analog signal state without converting the state signal into a differential signal, there is no reduction in the signal accuracy which may occur when converting the state signal to a differential signal. Therefore, the controller is capable of accurately determining the state of the head unit according to this application example based on the high-accuracy state signal which is transmitted from the head unit according to this application example. Therefore, by using the head unit according to this application example, it is possible to realize a liquid discharging apparatus which is capable of suppressing a reduction in the discharge accuracy of the liquid from the discharge unit and accurately performing the process.

The head unit according to this application example converts the differential signal which is transmitted from the controller to one serial format serial control signal to generate a plurality of types of control signal, and transmits the state signal to the controller as an analog signal which can be transferred using one signal line without using the differential signal which requires two signal lines for the transfer. Therefore, since the liquid discharging apparatus which uses the head unit according to this application example is capable of reducing the number of signal lines which are necessary for the transfer of the signal, it is possible to reduce costs.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, detailed description will be given of a favorable embodiment of the invention using the drawings. The drawings which are used facilitate explanation. The embodiment which is described below is not to wrongfully limit the content of the invention which is described in the claims. Not all of the configurations which are described hereinafter are necessary configuration requirements of the invention.

1. Electrical Configuration of Liquid Discharging Apparatus

A printing apparatus which is an example of the liquid discharging apparatus according to the present embodiment is an ink jet printer which forms an ink dot group on a printing medium such as paper by causing an ink to be discharged according to image data which is supplied from an external host computer, and so prints an image (including characters, figures, and the like) which correspond to the image data. Hereinafter, a line head system printer (a line printer) will be described as an example; however, a serial head system printer (a serial printer) may also be used. In addition to the printing apparatus such as a printer, examples of liquid discharging apparatuses include color material discharge apparatuses which are used in the manufacture of color filters of liquid crystal displays and the like, electrode material discharge apparatuses which are used to form electrodes of organic EL displays, field emission displays (FED), and the like, biological organic matter discharge apparatuses which are used in the manufacture of bio-chips, three-dimensional manufacturing apparatuses (so-called 3D printers), and textile printing apparatuses.

Figure 1:
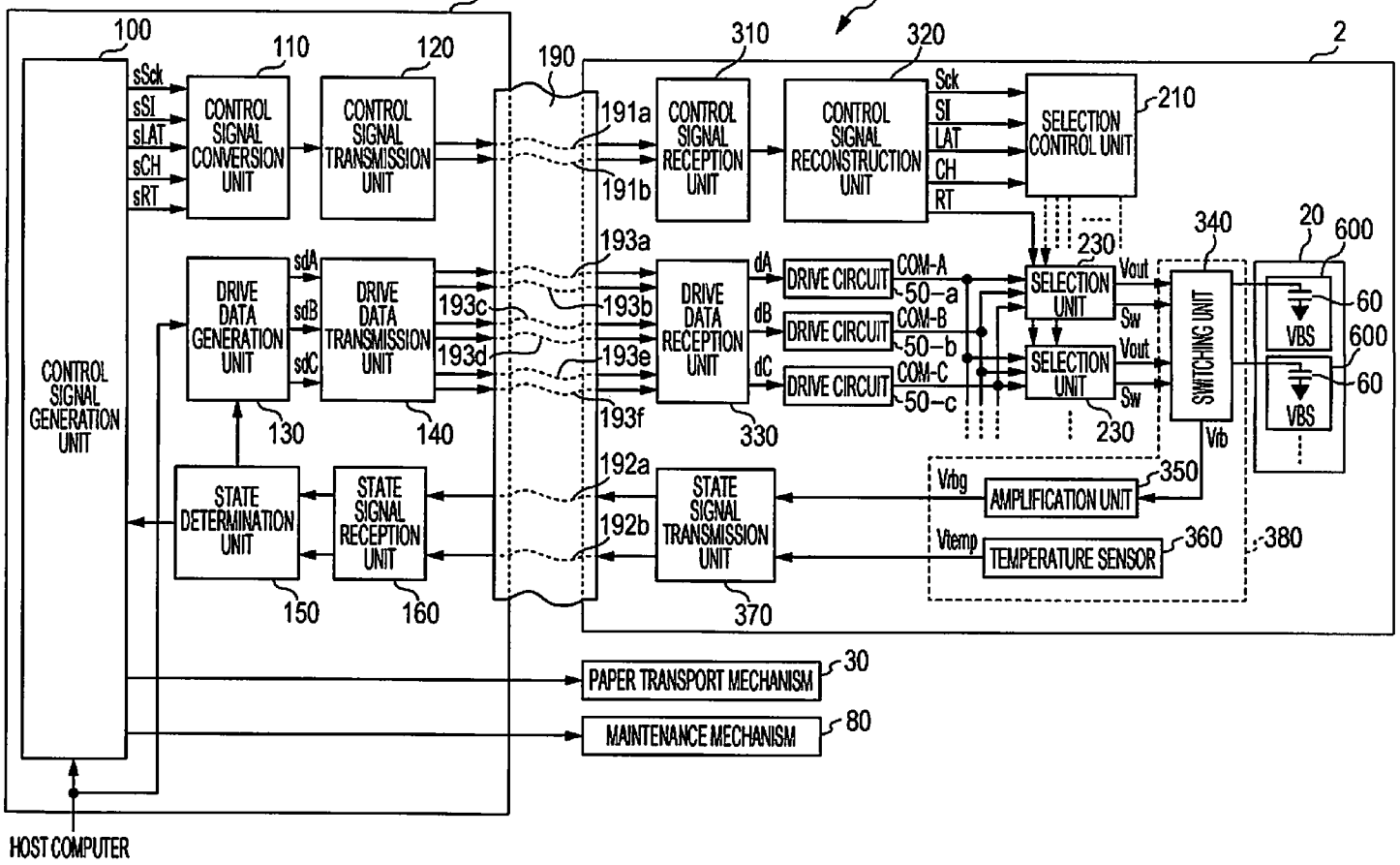
FIG. 1 is a block diagram illustrating the electrical configuration of a liquid discharging apparatus.

FIG. 1 is a block diagram illustrating the electrical configuration of a liquid discharging apparatus 1 of a first embodiment. As described later, the liquid discharging apparatus 1 is a line head printer in which a sheet S (refer to FIGS. 2 and 3) is transported in a predetermined direction, and is subjected to printing in a printing region during the transportation.

As illustrated in FIG. 1, the liquid discharging apparatus 1 is provided with a head unit 2 which includes discharge units 600 which discharge a liquid, a controller 10 which controls the discharging of the liquid, and a flexible flat cable 190 which connects the controller 10 to the head unit 2. The liquid discharging apparatus 1 may include a plurality of the head units 2; however, in FIG. 1, the single head unit 2 is illustrated in a representative manner.

The controller 10 includes a control signal generation unit 100, a control signal conversion unit 110, a control signal transmission unit 120, a drive data generation unit 130, a drive data transmission unit 140, a state determination unit 150, and a state signal reception unit 160.

When various signals such as image data are supplied from the host computer to the control signal generation unit 100, the control signal generation unit 100 outputs various control signals and the like for controlling the various parts. Specifically, the control signal generation unit 100 generates a control signal which controls a paper transport mechanism 30. The paper transport mechanism 30 supports the sheet S which is continuous and is wound in a roll shape such that the sheet S is capable of rotating, for example, and transports the sheet S by rotation so that predetermined characters, images, and the like are printed in the printing region. For example, the paper transport mechanism 30 transports the sheet S in a predetermined direction based on the control signal from the control signal generation unit 100.

The control signal generation unit 100 generates a control signal for causing a maintenance mechanism 80 to execute a maintenance process for normally restoring the discharging state of the ink in the discharge units 600. The maintenance mechanism 80 performs a cleaning process (a pumping process) and a wiping process based on the control signal from the control signal generation unit 100. In the cleaning process, ink with an increased viscosity, bubbles, and the like inside the discharge units 600 are sucked using a tube pump (not illustrated), and in the wiping process, foreign matter such as paper dust which is adhered to the vicinity of the nozzles of the discharge units 600 is wiped off using a wiper.

Based on various signals from the host computer, the control signal generation unit 100 generates an original clock signal sSck, an original print data signal sSI, an original latch signal sLAT, an original change signal sCH, and an original switching period specification signal sRT as a plurality of types of original control signal which control the discharging of the liquid from the discharge units 600, and outputs the generated original control signals to the control signal conversion unit 110 in a parallel format. A portion of these signals may not be included in the plurality of types of original control signal, and other signals may be included.

The control signal conversion unit 110 converts (serializes) the plurality of types of original control signal (the original clock signal sSck, the original print data signal sSI, the original latch signal sLAT, the original change signal sCH, and the original switching period specification signal sRT) which are output from the control signal generation unit 100 to one serial format serial control signal, and outputs the serial control signal to the control signal transmission unit 120. The control signal conversion unit 110 generates a transfer clock signal which is used for high speed serial data transfer via the flexible flat cable 190, and embeds the plurality of types of original control signal and the transfer clock signal in the serial control signal.

The control signal transmission unit 120 converts the serial control signal which is output from the control signal conversion unit 110 into a differential signal and transmits the differential signal to the head unit 2 via signal lines 191*a* and 191*b* (first signal lines) of the flexible flat cable 190. For example, the control signal transmission unit 120 converts the serial control signal into a differential signal of the low voltage differential signaling (LVDS) transfer system, and transmits the differential signal to the head unit 2. Since the amplitude of the differential signal of the LVDS transfer system is approximately 350 mV, it is possible to realize high speed data transfer. The control signal transmission unit 120 may transmit differential signals of various high speed transfer systems other than LVDS such as low voltage positive emitter coupled logic (LVPECL) and current mode logic (CML) to the head unit 2. The control signal conversion unit 110 may not embed the transfer clock signal in the serial control signal, and the control signal transmission unit 120 may transmit the transfer clock signal to the head unit 2 via signal lines which are independent of the signal lines 191*a* and 191*b*.

Based on various signals from the host computer, the drive data generation unit 130 generates original drive data sdA, sdB, and sdC, which are data indicating the drive signals which drive the discharge units 600 with which the head unit 2 is provided, and outputs the drive data sdA, sdB, and sdC to the drive data transmission unit 140 in a parallel format. For example, the original drive data sdA, sdB, and sdC may be digital data which is obtained by analog to digital conversion of the waveform (the drive waveform) of the drive signal, or may be digital data which defines the correspondence relationship between the lengths of each zone having a constant slope and the slopes thereof in the drive waveform.

The drive data transmission unit 140 converts original drive data sdA which is output from the drive data generation unit 130 into a serial format differential signal and transmits the differential signal to the head unit 2 via signal lines 193*a* and 193*b* (third signal lines) of the flexible flat cable 190. The drive data transmission unit 140 converts the original drive data sdB which is output from the drive data generation unit 130 into a serial format differential signal, and transmits the differential signal to the head unit 2 via signal lines 193*c* and 193*d* (third signal lines) of the flexible flat cable 190. The drive data transmission unit 140 converts the original drive data sdC which is output from the drive data generation unit 130 into a serial format differential signal, and transmits the differential signal to the head unit 2 via signal lines 193*e* and 193*f* (third signal lines) of the flexible flat cable 190. For example, the drive data transmission unit 140 may convert the original drive data sdA, sdB, and sdC into differential signals of a high speed transfer system such as LVDS, and may transmit the differential signals to the head unit 2. The drive data transmission unit 140 may serialize the original drive data sdA, sdB, and sdC into one serial format serial signal and convert the serial signal into a differential signal to transmit the differential signal to the head unit 2. The drive data transmission unit 140 may embed the transfer clock signal which is used in high speed serial data transfer in the differential signal, or may transmit the transfer clock signal to the head unit 2 via signal lines which are independent of the signal lines 193*a*, 193*b*, 193*c*, 193*d*, 193*e*, and 193*f*.

The state signal reception unit 160 receives state signals indicating the state of the head unit 2 which are transmitted from the head unit 2 in analog format via signal lines 192*a* and 192*b* (second signal lines). In the present embodiment, the state signal reception unit 160 receives a residual vibration signal Vrbg indicating the residual vibration of the discharge units after the discharge units 600 with which the head unit 2 is provided are driven, as one of the state signals via the signal line 192*a*. The state signal reception unit 160 receives a temperature signal Vtemp indicating the temperature of the head unit 2 as one of the state signals via the signal line 192*b*, and outputs the temperature signal Vtemp to the state determination unit 150. The state signal reception unit 160 may receive only one of either the residual vibration signal or the temperature signal as a state signal, or may receive other state signals.

The state determination unit 150 determines the state of the discharge units 600 based on the state signal which is received and output by the state signal reception unit 160. For example, the state determination unit 150 may generate a shaped waveform signal which is obtained by removing a noise component from the residual vibration signal using a low pass filter or a band pass filter for each of the discharge units 600, may measure the frequency (the period), the attenuation rate of the amplitude, and the like of the shaped waveform signal, and may determine whether or not there is a discharge fault or the like based on the measurement results. The state determination unit 150 may determine the level of the internal temperature of the head unit 2 from among a plurality of levels based on the voltage value of the temperature signal.

The control signal generation unit 100 also performs processing according to the determination results of the state determination unit 150. For example, in a case in which it is determined by the state determination unit 150 that there is a discharge fault, the control signal generation unit 100 may generate a control signal for causing the maintenance mechanism 80 to execute a maintenance process. For example, in a case in which it is determined by the state determination unit 150 that there is a discharge fault, the control signal generation unit 100 may generate the original print data signal sSI for performing a complementary recording process which complements the recording (the printing) on the sheet S by the discharge units 600 which do not have discharge faults instead of the discharge units 600 which have discharge faults. Even in a case in which a discharge abnormality arises in the discharge units 600, by executing the complementary recording process, it is possible to continue the printing process without stopping the printing process to perform the maintenance process. For example, in a case in which it is determined by the state determination unit 150 that the internal temperature of the head unit 2 exceeds a predetermined level (reaches too high a temperature), the control signal generation unit 100 may decrease the speed of the printing or generate an original control signal (the original clock signal sSck, the original print data signal sSI, the original latch signal sLAT, the original change signal sCH, and the original switching period specification signal sRT) for suspending the printing.

The drive data generation unit 130 also performs processing according to the determination results of the state determination unit 150. For example, the drive data generation unit 130 may change the original drive data sdA, sdB, sdC based on the level of the internal temperature of the head unit 2 which is determined by the state determination unit 150 such that the slope and the amplitude of the drive waveform which is applied to the discharge unit 600 are fine tuned according to the temperature characteristics of drive circuits 50-*a*, 50-*b*, and 50-*c* which are provided in the head unit 2, the temperature characteristics of piezoelectric elements 60 of the discharge unit 600, and the like.

The head unit 2 includes a control signal reception unit 310, a control signal reconstruction unit 320, a drive data reception unit 330, the drive circuits 50-*a*, 50-*b*, and 50-*c*, a selection control unit 210, a plurality of selection units 230, a switching unit 340, a head 20, an amplification unit 350, a temperature sensor 360, and a state signal transmission unit 370. Although only the single head 20 is illustrated in FIG. 1, the head unit 2 of the present embodiment may include a plurality of the heads 20.

The control signal reception unit 310 receives the differential signal which is transmitted from the controller 10 via the signal lines 191*a* and 191*b* (first signal lines), converts the received differential signal into a serial control signal, and outputs the serial control signal to the control signal reconstruction unit 320. Specifically, the control signal reception unit 310 may receive the differential signal of the LADS transfer system, differentially amplify the differential signal, and convert the differential signal into the serial control signal.

Based on the serial control signal which is converted by the control signal reception unit 310, the control signal reconstruction unit 320 generates a plurality of types of control signal (a clock signal Sck, a print data signal SI, a latch signal LAT, a change signal CH, and a switching period specification signal RT) which control the discharging of the liquid from the discharge units 600. Specifically, the control signal reconstruction unit 320 reconstructs the transfer clock signal which is embedded in the serial control signal which is output from the control signal reception unit 310, and based on the transfer clock signal, generates the plurality of types of parallel format control signal (the clock signal Sck, the print data signal SI, the latch signal LAT, the change signal CH, and the switching period specification signal RT) by reconstructing the plurality of types of original control signal (the original clock signal sSck, the original print data signal sSI, the original latch signal sLAT, the original change signal sCH, and the original switching period specification signal sRT) which are included in the serial control signal.

The drive data reception unit 330 receives the differential signals of the original drive data sdA, sdB, and sdC which is transmitted from the controller 10, and outputs drive data dA, dB, and dC, which are data indicating the drive signals which drive the discharge units 600. Specifically, the drive data reception unit 330 differentially amplifies the received differential signal, reconstructs the transfer clock signal which is embedded in the differentially amplified signal, and based on the transfer clock signal, outputs the parallel format drive data dA, dB, dC by reconstructing the original drive data sdA, sdB, and sdC which is included in the differentially amplified signal.

The drive circuits 50-*a*, 50-*b*, and 50-*c* generate the drive signals COM-A, COM-B, and COM-C for driving each of the discharge units 600 based on the drive data dA, dB, and dC which is output from the drive data reception unit 330. For example, if the drive data dA, dB, and dC are digital data which are obtained by analog to digital conversion of the waveforms of the drive signals COM-A, COM-B, and COM-C, respectively, the drive circuits 50-*a*, 50-*b*, and 50-*c* convert the drive data dA, dB, and dC respectively into from digital to analog, and subsequently perform class D amplification to generate the drive signals COM-A, COM-B, and COM-C. For example, if the drive data dA, dB, and dC are digital data which define the correspondence relationships between the lengths of each zone having a constant slope and the slopes thereof in the waveforms of the drive signals COM-A, COM-B, and COM-C, respectively, the drive circuits 50-*a*, 50-*b*, and 50-*c* generate analog signals which satisfy the correspondence relationships between the lengths of each zone and the slopes thereof which are defined in the drive data dA, dB, and dC respectively, and subsequently perform class D amplification to generate the drive signals COM-A, COM-B, and COM-C. In this manner, the drive data dA, dB, and dC are data defining the waveforms of the drive signals COM-A, COM-B, and COM-C, respectively. The drive circuits 50-*a*, 50-*b*, and 50-*c* differ only in the input data and the output drive signals, and the circuit configurations may be the same.

The selection control unit 210 instructs each of the selection units 230 to select one of the drive signals COM-A and COM-B (or whether to select none of drive signals) using the plurality of types of control signal (the clock signal Sck, the print data signal SI, the latch signal LAT, and the change signal CH) which are output from the control signal generation unit 100.

Each of the selection units 230 selects the drive signal COM-A, COM-B, or COM-C in accordance with the instruction of the selection control unit 210, and outputs the drive signal COM-A, COM-B, or COM-C to the switching unit 340 as the drive signal Vout. Here, the drive signals COM-A and COM-B are signals for driving each of the discharge units 600 to discharge the liquid, and the drive signal COM-C is a signal for examining the discharge faults of each of the discharge units 600.

Each of the selection units 230 generates a selection signal Sw based on the switching period specification signal RT which is output from the control signal generation unit 100, and outputs the selection signal Sw to the switching unit 340. In the present embodiment, the selection signal Sw is a signal that becomes high level only when the switching period specification signal RT is high level and the drive signal COM-C is selected.

When the selection signal Sw which is output from the selection unit 230 is at a low level, the switching unit 340 performs control such that the drive signal Vout is applied to one terminal of the piezoelectric element 60 of the corresponding discharge unit 600, and when the selection signal Sw is at a high level, the switching unit 340 performs control such that the drive signal Vout is not applied to the one terminal of the piezoelectric element 60. A voltage VBS is applied in common to the other terminals of the piezoelectric elements 60. The piezoelectric element 60 is displaced by the application of the drive signal Vout. The piezoelectric element 60 is provided corresponding to each of the plurality of discharge units 600 in the head 20. The piezoelectric element 60 is displaced in accordance with the potential difference between the drive signal Vout and the voltage VBS and discharges the ink.

In the present embodiment, the switching period specification signal RT is always at the low level in the printing period, and in the inspection period, the switching period specification signal RT periodically repeats the low level and the high level. In other words, in the printing period, the drive signal Vout is always applied to all of the discharge units 600. In the inspection period, the drive signal Vout is always applied to the non-inspection target discharge units 600 (the discharge units 600 corresponding to the selection units 230 which do not select the drive signal COM-C as the drive signal Vout); however, in the inspection target discharge units 600 (the discharge units 600 corresponding to the selection units 230 which select the drive signal COM-C as the drive signal Vout), after the drive signal Vout is applied, the drive signal Vout is not applied for a fixed period, and during the fixed period, a signal which manifests in the one terminal of the piezoelectric element 60 of the discharge unit 600 is output from the switching unit 340 as the residual vibration signal Vrb.

The amplification unit 350 generates the residual vibration signal Vrbg which is obtained by amplifying the residual vibration signal Vrb as one of the state signals indicating the state of the head unit 2, and outputs the residual vibration signal Vrbg to the state signal transmission unit 370.

The temperature sensor 360 detects the temperature of the head unit 2, generates the temperature signal Vtemp indicating the temperature of the head unit 2 as one of state signals indicating the state of the head unit 2, and outputs the temperature signal Vtemp to the state signal transmission unit 370. For example, the temperature sensor 360 may be provided in a position at which it is possible to detect, as the temperature of the head unit 2, any one of the temperature of a member easily becomes high temperature, the temperature of a nozzle 651 or a nozzle plate 632 (refer to FIG. 4), the temperature of transfer gates 234*a*, 234*b*, and 234*c* (refer to FIG. 9) of the selection unit 230, the temperature of the internal space of the head 20, and the temperatures of the drive circuits 50-*a*, 50-*b*, and 50-*c*. Alternatively, a plurality of the temperature sensors 360, which detect corresponding temperatures of a plurality of members which easily become high temperature, may be provided in different positions from each other in the head unit 2.

In this manner, the switching unit 340, the amplification unit 350, and the temperature sensor 360 configure a state signal generation unit 380 which detects the state of the head unit 2 to generate the state signal (the residual vibration signal Vrbg and the temperature signal Vtemp).

The state signal transmission unit 370 transmits the residual vibration signal Vrbg as a state signal to the controller 10 in an analog format via the signal line 192*a* of the flexible flat cable 190. The state signal transmission unit 370 transmits the temperature signal Vtemp as a state signal to the controller 10 in an analog format via the signal line 192*b* of the flexible flat cable 190.

Since the drive signals COM-A, COM-B, and COM-C are signals for driving the discharge units 600, the drive signals COM-A, COM-B, and COM-C are high voltage (several ten V) signals, and drive circuits 50-*a*, 50-*b*, and 50-*c* which generate the drive signals COM-A, COM-B, and COM-C, respectively, have high power consumption and easily reach high temperatures. When the waveforms of the drive signals COM-A, COM-B, and COM-C change in accordance with the temperature characteristics of the drive circuits 50-*a*, 50-*b*, and 50-*c*, the discharge accuracy of the liquid from the discharge units 600 is influenced. Therefore, the temperature sensor 360 is provided in the vicinity of the drive circuits 50-*a*, 50-*b*, and 50-*c*, and the state determination unit 150 which is provided in the controller 10 may determine the state of the head unit 2 based on the temperature signal Vtemp indicating the temperature of the drive circuits 50-*a*, 50-*b*, and 50-*c*. Even if the waveforms of the drive signals COM-A, COM-B, and COM-C are temperature-corrected, the discharge characteristics change depending on the temperature characteristics of the piezoelectric elements 60, and as a result, the discharge accuracy of the liquid is influenced. Therefore, the temperature sensor 360 is provided in the vicinity of the discharge units 600 (the piezoelectric elements 60) (for example, in the vicinity of the nozzle plate 632), and the state determination unit 150 may determine the state of the head unit 2 based on the temperature signal Vtemp indicating the temperature of the discharge units 600 (the piezoelectric elements 60). The control signal generation unit 100 and the drive data generation unit 130 perform processing according to the determination result of the state determination unit 150, thereby increasing the discharge accuracy of the liquid from the discharge units 600.

2. Structure of Liquid Discharging Apparatus

Figure 2:
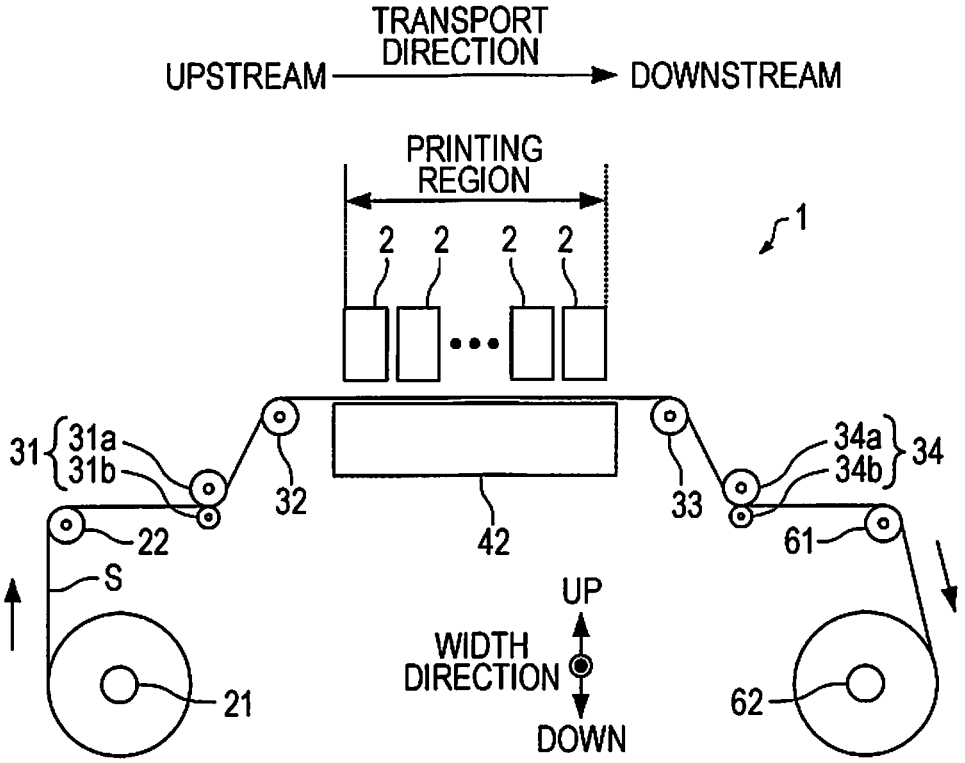
FIG. 2 is a schematic sectional diagram of the liquid discharging apparatus.

FIG. 2 is a schematic sectional diagram of the liquid discharging apparatus 1. In the example of FIG. 2, description is given assuming that the sheet S which serves as the printing medium is continuous paper which is wound in a roll shape; however, the printing medium on which the liquid discharging apparatus 1 prints an image is not limited to continuous paper, and may be cut paper, fabric, film, or the like.

The liquid discharging apparatus 1 includes a winding shaft 21 which feeds out the sheet S by rotation, and a relay roller 22 which guides the sheet S, which is fed out from the winding shaft 21 and is wound on the winding shaft 21, to an upstream-side transport roller pair 31. The liquid discharging apparatus 1 includes a plurality of relay rollers 32 and 33 for winding and feeding the sheet S, the upstream-side transport roller pair 31 which is installed on the upstream side in the transport direction with respect to the printing region, and a downstream-side transport roller pair 34 which is installed on the downstream side in the transport direction with respect to the printing region. The upstream-side transport roller pair 31 and the downstream-side transport roller pair 34 respectively include drive rollers 31*a* and 34*a* connected to a motor (not illustrated) and rotationally driven, and follower rollers 31*b* and 34*b* which rotate with the rotation of the drive rollers 31*a* and 34*a*. The transporting force is applied to the sheet S through the rotational driving of the drive rollers 31*a* and 34*a* in a state in which the upstream-side transport roller pair 31 and the downstream-side transport roller pair 34 hold the sheet S therebetween. The liquid discharging apparatus 1 includes a relay roller 61 which winds and feeds the sheet S which is fed from the downstream-side transport roller pair 34, and a winding drive shaft 62 which winds the sheet S which is fed from the relay roller 61. As the winding drive shaft 62 is driven to rotate, the printed sheet S is sequentially wound up in a roll shape. These rollers and motors (not illustrated) correspond to the paper transport mechanism 30 of FIG. 1.

The liquid discharging apparatus 1 includes the head unit 2, and a platen 42 which supports the sheet S from the opposite side surface from the printing surface in the printing region. The liquid discharging apparatus 1 may be provided with a plurality of the head units 2. For example, the liquid discharging apparatus 1 may prepare the head unit 2 for each color of ink, and may be configured to include four of the head units 2 which are lined up in the transport direction and capable of discharging the four colors of ink of yellow (Y), magenta (M), cyan (C), and black (K). In the following description, the single head unit 2 is described in a representative manner.

Figure 3:
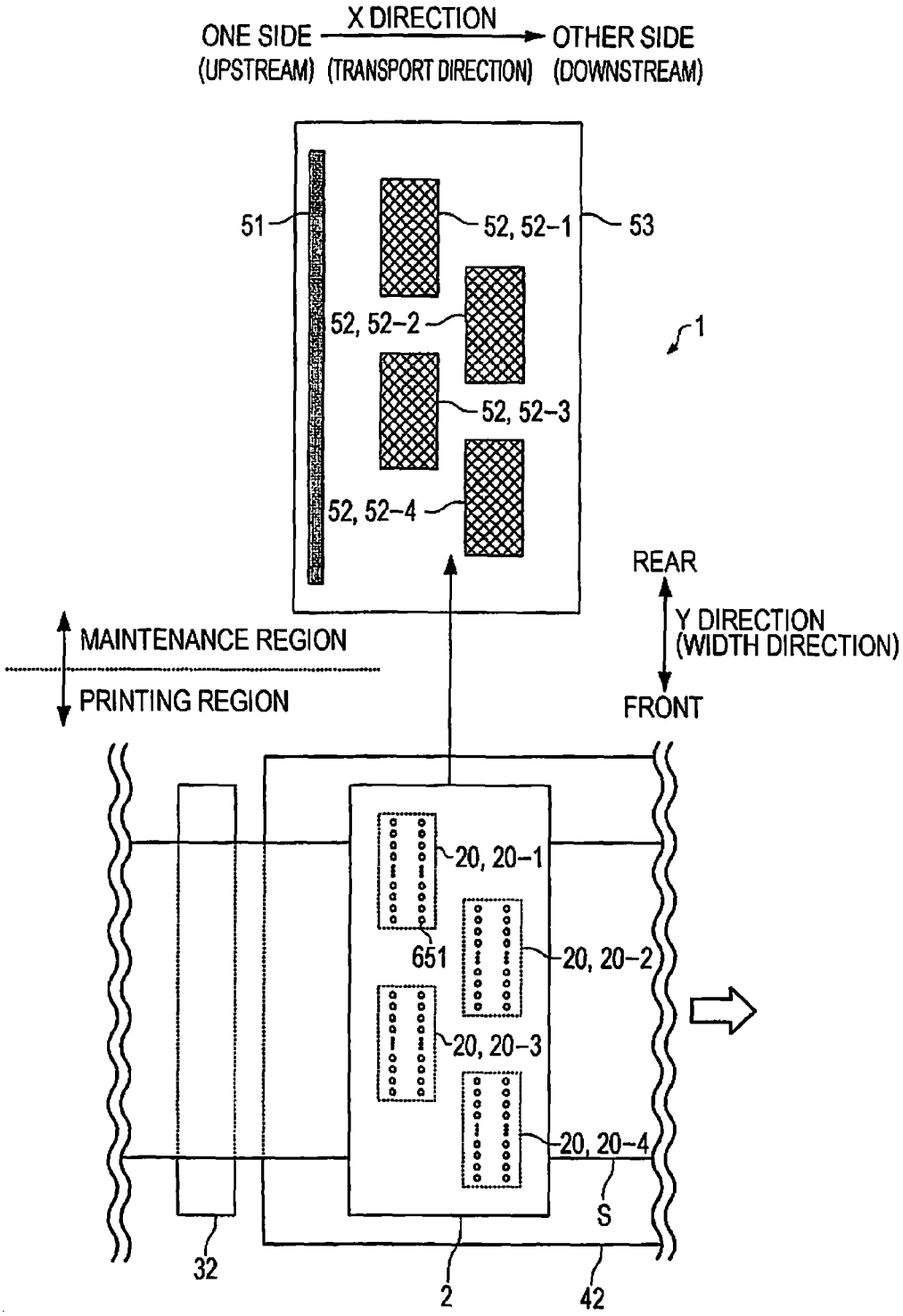
FIG. 3 is a schematic top surface diagram of the liquid discharging apparatus.

As illustrated in FIG. 3, in the head unit 2, the plurality of heads 20 (20-1 to 20-4) are lined up in the width direction (the Y direction) of the sheet S, intersecting the transport direction of the sheet S. To facilitate explanation, the numbers are assigned in ascending order from the head 20 of the far side in the Y direction. Multiple nozzles 651 which discharge the ink are lined up in the Y direction at a predetermined interval on the surface (the bottom surface) of the each of the heads 20 which faces the sheet S. In FIG. 3, the positions of the heads 20 and the nozzles 651 are virtually illustrated as appear when viewing the head unit 2 from above. The positions of the nozzles 651 at the end portions of the heads 20 (for example, the head 20-1 and the head 20-3) which are adjacent to each other in the X direction at least partially overlap, and on the bottom surface of the head unit 2, the nozzles 651 are lined up at a predetermined interval in the Y direction across the width of the sheet S or greater. Therefore, the head unit 2 prints a two-dimensional image on the sheet S by discharging the ink from the nozzles 651 with respect to the sheet S which is transported without stopping under the head unit 2.

In FIG. 3, for convenience of the drawing, four heads 20 belonging to the head unit 2 are illustrated; however, the invention is not limited to thereto. In other words, the number of heads 20 may be more or less than four. The heads 20 of FIG. 3 are disposed in a staggered lattice pattern; however, the invention is not limited to such a disposition.

In the present embodiment, the sheet S is supported by the horizontal surface of the platen 42; however, the invention is not limited thereto. For example, a configuration may be adopted in which a rotating drum which rotates around the width direction of the sheet S as a rotation axis is the platen 42, and the ink is discharged from the head 20 while winding the sheet S around the rotating drum and transporting the sheet S. In this case, the head unit 2 is disposed to be inclined along the outer circumferential surface of the arc shape of the rotating drum. For example, in a case in which the ink which is discharged from the head 20 is a UV ink which is cured by being irradiated with ultraviolet rays, an irradiator which irradiates ultraviolet rays may be provided on the downstream side of the head unit 2.

Here, the liquid discharging apparatus 1 is provided with a maintenance region for performing the maintenance process of the head unit 2. A wiper 51, a plurality of caps 52, and an ink receiving portion 53 are present in the maintenance region of the liquid discharging apparatus 1. The maintenance region is positioned on the far side in the Y direction with respect to the platen 42 (that is, the printing region), and the head unit 2 moves to the far side in the Y direction during maintenance.

The wiper 51 and the cap 52 are supported by the ink receiving portion 53 and are capable of moving in the X direction (the transport direction of the sheet S) due to the ink receiving portion 53. The wiper 51 is a plate-shaped member which is erected from the ink receiving portion 53, and is formed of an elastic member, fabric, felt, or the like. The cap 52 is a rectangular parallelepiped member which is formed of an elastic member or the like, and is provided for each of the heads 20. The caps 52 (52-1 to 52-4) are also lined up in the width direction to be aligned with the disposition of the heads 20 (20-1 to 20-4) in the head unit 2. Accordingly, when the head unit 2 moves to the far side in the Y direction, the heads 20 and the caps 52 face each other, and when the head unit 2 is lowered (or when the caps 52 are raised), the caps 52 come into close contact with the nozzle opening surfaces of the heads 20, and it is possible to seal the nozzles 651. The ink receiving portion 53 also takes on the role of receiving the ink which is discharged from the nozzles 651 during the maintenance of the heads 20.

When ink is discharged from the nozzles 651 which are provided in the heads 20, minute ink droplets are generated together with the main ink droplets, and the minute ink droplets fly up as a mist and adhere to the nozzle opening surfaces of the heads 20. Not only the ink, but also dust, paper dust, and the like adhere to the nozzle opening surfaces of the heads 20. When the foreign matter is deposited by being adhered to the nozzle opening surfaces of the heads 20 and left unattended, the nozzles 651 are blocked, and ink discharging from the nozzles 651 is impeded. Therefore, as described above, in the liquid discharging apparatus 1, the maintenance mechanism 80 performs a cleaning process (a pumping process) and a wiping process as a maintenance process based on a control signal from the control signal generation unit 100. The wiper 51, the caps 52, and the ink receiving portion 53 correspond to a portion of the maintenance mechanism 80 of FIG. 1.

3. Configuration of Discharge Unit

Figure 4:
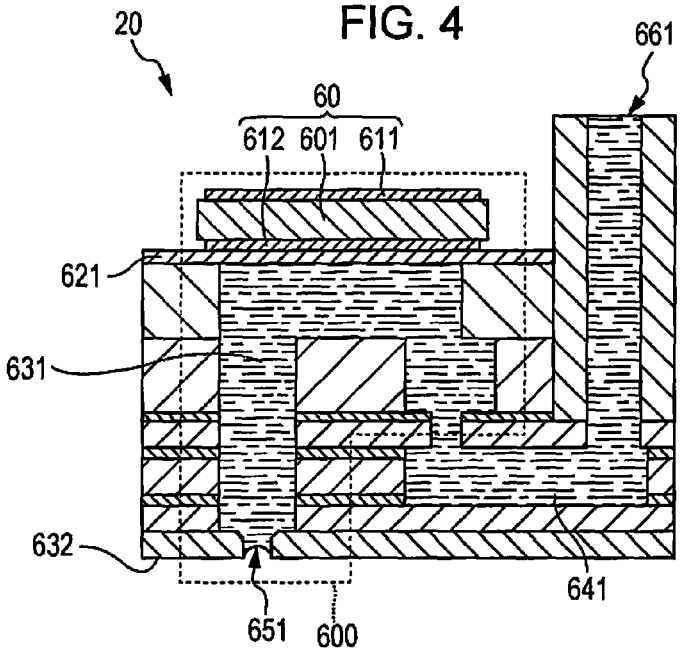
FIG. 4 is a diagram illustrating the configuration of a discharge unit in a head.

FIG. 4 is a diagram illustrating the schematic configuration corresponding to one of the discharge units 600 in the head 20. As illustrated in FIG. 4, the head 20 includes the discharge unit 600 and a reservoir 641.

The reservoir 641 is provided for each color of ink, and the ink is introduced to the reservoir 641 from a supply port 661. The ink may be supplied to the supply port 661 from an ink cartridge which is installed on the head unit 2, or may be supplied to the supply port 661 independently from the head unit 2 via an ink tube from an ink tank which is attached to the main body side.

The discharge unit 600 includes the piezoelectric element 60, a vibration plate 621, a cavity (a pressure chamber) 631, and the nozzle 651. Of these, the vibration plate 621 functions as a diaphragm which is displaced (subjected to flexural vibration) by the piezoelectric element 60 which is provided on the top surface in FIG. 4 and causes the internal volume of the cavity 631, which is filled with the ink, to expand and contract. The nozzle 651 is provided in the nozzle plate 632 and is an opening portion which communicates with the cavity 631. The cavity 631 is filled with a liquid (for example, the ink), and the internal volume is changed by the displacement of the piezoelectric element 60. The nozzle 651 communicates with the cavity 631 and discharges the liquid in the cavity 631 as droplets in accordance with the change in the internal volume of the cavity 631.

The piezoelectric element 60 illustrated in FIG. 4 has a structure in which a piezoelectric body 601 is interposed between a pair of electrodes 611 and 612. In the piezoelectric body 601 of this structure, corresponding to a voltage which is applied by the electrodes 611 and 612, in FIG. 4, the central portion of the piezoelectric body 601 flexes in the up-down direction with respect to both terminal portions thereof together with the electrodes 611, 612, and the vibration plate 621. Specifically, when the voltage of the drive signal Vout increases, the piezoelectric element 60 flexes in the upward direction, whereas when the voltage of the drive signal Vout decreases, the piezoelectric element 60 flexes in the downward direction. In this configuration, if the piezoelectric body 601 flexes in the upward direction, since the internal volume of the cavity 631 expands, the ink is drawn in from the reservoir 641; however, if the piezoelectric body 601 flexes in the downward direction, since the internal volume of the cavity 631 contracts, the ink is discharged from the nozzle 651 depending on the degree of the contraction.

The piezoelectric element 60 is not limited to the illustrated structure and may be of any type as long as it is possible to deform the piezoelectric element 60 to cause a liquid such as the ink to be discharged. The piezoelectric element 60 is not limited to flexural vibration, and so-called longitudinal vibration may be used.

The piezoelectric element 60 is provided corresponding to the cavity 631 and the nozzle 651 in the head 20, and is also provided corresponding to the selection unit 230. Therefore, the set of the piezoelectric element 60, the cavity 631, the nozzle 651, and the selection unit 230 is provided for each of the nozzles 651.

4. Relationship Between Discharge Fault and Residual Vibration of Discharge Unit Incidentally, even though the discharge unit 600 performs an operation for discharging ink droplets, there is a case in which an ink droplet is not normally discharged from the nozzle 651, that is, a discharge fault occurs. Possible reasons for the occurrence of discharge faults include (1) mixing of air bubbles into the cavity 631, (2) an increase in viscosity or adhesion of the ink inside the cavity 631 due to drying of the ink inside the cavity 631 or the like, and (3) adhesion of foreign matter such as paper dust to the vicinity of the outlet of the nozzle 651, and the like.

First, in a case in which bubbles are mixed into the cavity 631, it is conceivable that the total weight of the ink which fills the inside of the cavity 631 decreases and the inheritance is reduced. In a case in which bubbles are adhered to the vicinity of the nozzle 651, it is conceivable that the diameter of the nozzle 651 is considered to be increased by the size of the diameter of the bubbles, and the acoustic resistance is reduced. Therefore, in a case in which bubbles are mixed into the cavity 631 and a discharge fault occurs, the frequency of the residual vibration is higher as compared with a case in which the discharging state is normal. Due to the reduction in the acoustic resistance or the like, the attenuation rate of the amplitude of the residual vibration decreases.

Next, in a case in which the ink in the vicinity of the nozzle 651 is dried and adhered, the ink inside the cavity 631 assumes a state of being confined in the cavity 631. In such a case, it is conceivable that the acoustic resistance will increase. Therefore, in a case in which the ink in the vicinity of the nozzle 651 in the cavity 631 is adhered, the frequency of the residual vibration becomes extremely low and the residual vibration becomes excessively attenuated, as compared with the case in which the discharging state is normal.

Next, in a case in which foreign matter such as paper dust adheres to the vicinity of the outlet of the nozzle 651, since the ink seeps out from the inside of the cavity 631 via foreign matter such as paper dust, is considered that the inheritance will increase. It is also considered that the acoustic resistance will increase due to the fibers of the paper dust which is adhered to the vicinity of the outlet of the nozzle 651. Therefore, in a case in which foreign matter such as paper dust adheres to the vicinity of the outlet of the nozzle 651, the frequency of the residual vibration becomes lower as compared with the case in which the discharging state is normal.

As described above, the state determination unit 150 can determine the presence or absence of discharge faults based on the attenuation rate (the attenuation time) of the frequency and amplitude of the residual vibration signal.

5. Configuration of Drive Signal of Discharge Unit

In addition to a method of forming a single dot by discharging an ink droplet once, assuming that it is possible to discharge the ink droplet two or more times in a unit period, there is a method (a second method) of forming a single dot by causing one or more ink droplets which are discharged in a unit period to land and causing the one or more ink droplets which are landed to bond, and a method (a third method) of forming two or more dots without causing the two or more ink droplets to bond.

In the present embodiment, according to the second method, by discharging the ink at most twice for a single dot, four levels of gradation of "large dot", "medium dot", "small dot" and "non-recording (no dot)" are expressed. In order to express the four levels of gradation, in the present embodiment, two types of the drive signal COM-A and COM-B are prepared, and each of the drive signals COM-A and COM-B holds an early half pattern and a latter half pattern in one period. A configuration is adopted in which, in one period, the drive signals COM-A and COM-B are selected (or not selected) according to the gradation to be expressed in the early half and the latter half, and are supplied to the piezoelectric element 60. In the present embodiment, in order to generate the drive signal Vout corresponding to "inspection", the drive signal COM-C is prepared separately from the drive signals COM-A and COM-B.

Figure 5:
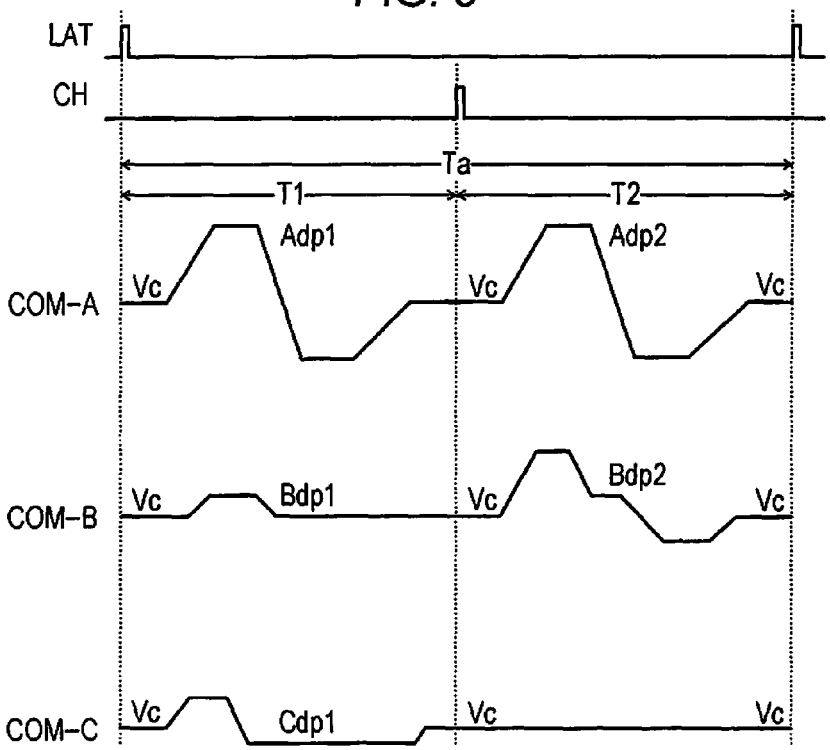
FIG. 5 is a diagram illustrating waveforms of drive signals.

FIG. 5 is a diagram illustrating waveforms of the drive signals COM-A, COM-B, and COM-C. As illustrated in FIG. 5, the drive signal COM-A is a waveform in which a trapezoidal waveform Adp2 continues from a trapezoidal waveform Adp1. The trapezoidal waveform Adp1 is disposed in a period T1 from the leading edge of the latch signal LAT until the leading edge of the change signal CH, and the trapezoidal waveform Adp2 is disposed in a period T2 from the leading edge of the change signal CH until the leading edge of the next latch signal LAT. A period formed of the period T1 and the period T2 is defined as a period Ta, and a new dot is formed on the sheet S for every period Ta.

In the present embodiment, the trapezoidal waveforms Adp1 and Adp2 are substantially the same waveform as each other, and the trapezoidal waveforms Adp1 and Adp2 are waveforms which, if hypothetically supplied to one terminal of the piezoelectric element 60, cause a predetermined amount, specifically, approximately a medium amount of the ink to be discharged from the nozzle 651 corresponding to the piezoelectric element 60.

The drive signal COM-B is a waveform in which a trapezoidal waveform Bdp2 which is disposed in the period T2 continues from a trapezoidal waveform Bdp1 which is disposed in the period T1. In the present embodiment, the trapezoidal waveforms Bdp1 and Bdp2 are waveforms which are different from each other. Of the two, the trapezoidal waveform Bdp1 is a waveform for subjecting the ink in the proximity of the opening portion of the nozzle 651 to minute vibrations to prevent an increase in the viscosity of the ink. Therefore, even if the trapezoidal waveform Bdp1 is hypothetically supplied to one terminal of the piezoelectric element 60, an ink droplet is not discharged from the nozzle 651 corresponding to the piezoelectric element 60. The trapezoidal waveform Bdp2 is a waveform which is different from the trapezoidal waveform Adp1 (Adp2). The trapezoidal waveform Bdp2 is a waveform which, if hypothetically supplied to one terminal of the piezoelectric element 60, will cause a smaller amount of the ink than the predetermined amount to be discharged from the nozzle 651 corresponding to the piezoelectric element 60.

The drive signal COM-C is a waveform in which a waveform of a fixed voltage Vc which is disposed in the period T2 continues from a trapezoidal waveform Cdp1 which is disposed in the period T1. The trapezoidal waveform Cdp1 is a waveform for causing the ink in the vicinity of the opening of the nozzle 651 to vibrate to generate the desired residual vibration which is necessary for the inspection. Even if the trapezoidal waveform Cdp1 is supplied to one terminal of the piezoelectric element 60, an ink droplet is not discharged from the nozzle 651 corresponding to the piezoelectric element 60.

The voltages at the start timing and the voltages at the end timing of the trapezoidal waveforms Adp1, Adp2, Bdp1, Bdp2, and Cdp1 are all common at the voltage Vc. In other words, each of the trapezoidal waveforms Adp1, Adp2, Bdp1, Bdp2, and Cdp1 is a waveform which starts at the voltage Vc and ends at the voltage Vc.

Figure 6:
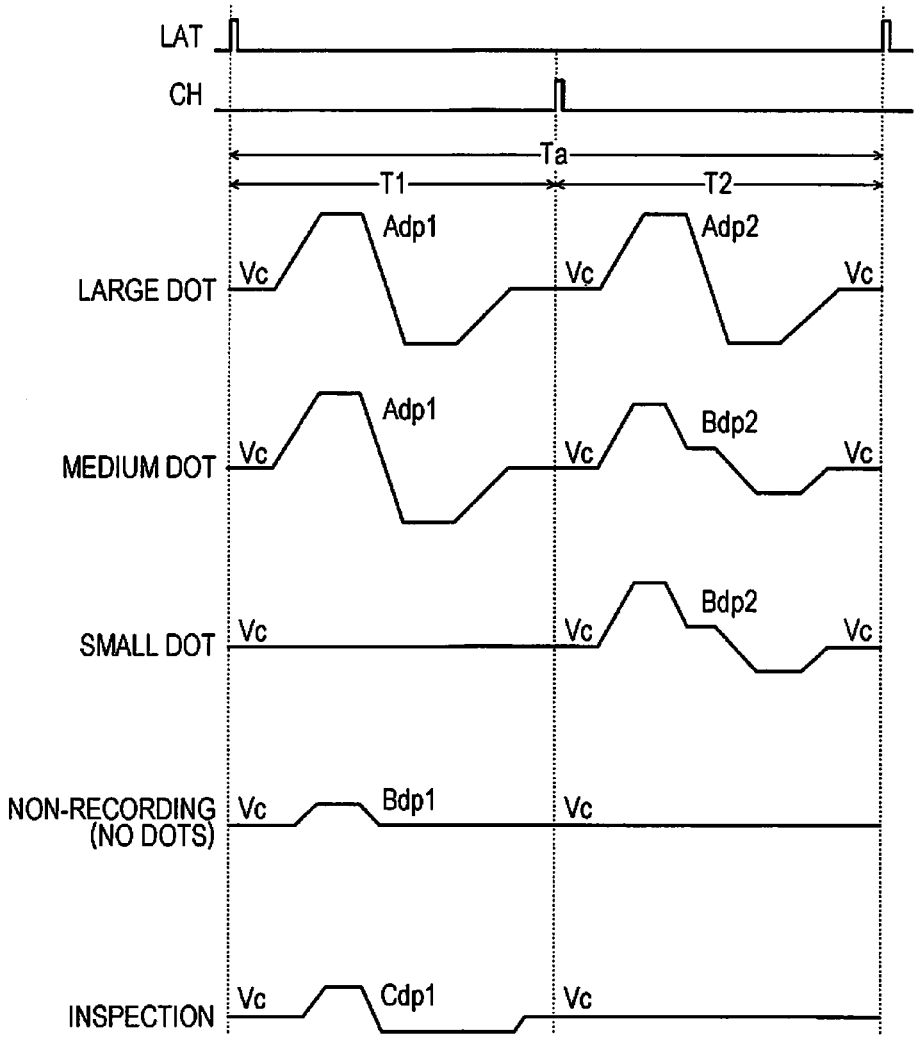
FIG. 6 is a diagram illustrating waveforms of drive signal.

FIG. 6 is a diagram illustrating waveforms of the drive signal Vout corresponding to each of "large dot", "medium dot", "small dot", "non-recording" and "inspection".

As illustrated in FIG. 6, the drive signal Vout corresponding to the "large dot" is a waveform which is obtained by causing the trapezoidal waveform Adp2 of the drive signal COM-A in the period T2 to continue from the trapezoidal waveform Adp1 of the drive signal COM-B in the period T1. When the drive signal Vout is supplied to one terminal of the piezoelectric element 60, approximately a medium amount of the ink is discharged in two times from the nozzle 651 corresponding to the piezoelectric element 60 in the period Ta. Therefore, the ink of both times lands on the sheet S and combines to form a large dot.

The drive signal Vout corresponding to the "medium dot" is a waveform which is obtained by causing the trapezoidal waveform Bdp2 of the drive signal COM-C in the period T2 to continue from the trapezoidal waveform Adp1 of the drive signal COM-A in the period T1. When the drive signal Vout is supplied to one terminal of the piezoelectric element 60, approximately a medium amount of the ink approximately a small amount of the ink are discharged in two times from the nozzle 651 corresponding to the piezoelectric element 60 in the period Ta. Therefore, the ink of both times lands on the sheet S and combines to form a medium dot.

The drive signal Vout corresponding to the "small dot" assumes the voltage Vc directly preceding which is held due to the capacitance of the piezoelectric element 60 in the period T1, and becomes the trapezoidal waveform Bdp2 of the drive signal COM-B in the period T2. When the drive signal Vout is supplied to one terminal of the piezoelectric element 60, in the period Ta, approximately a small amount of the ink is discharged from the nozzle 651 corresponding to the piezoelectric element 60 only in the period T2. Therefore, the ink lands on the sheet S to form a small dot.

The drive signal Vout corresponding to "non-recording" becomes the trapezoidal waveform Bdp1 of the drive signal COM-B in the period T1, and assumes the voltage Vc directly preceding which is held due to the capacitance of the piezoelectric element 60 in the period T2. When the drive signal Vout is supplied to one terminal of the piezoelectric element 60, in the period Ta, the nozzle 651 corresponding to the piezoelectric element 60 is only subjected to minute vibrations in the period T2, and the ink is not discharged. Therefore, the ink does not land on the sheet S, and a dot is not formed.

The drive signal Vout corresponding to "inspection" becomes the trapezoidal waveform Cdp1 of the drive signal COM-C in the period T1, and assumes the voltage Vc directly preceding which is held due to the capacitance of the piezoelectric element 60 in the period T2. When the drive signal Vout for inspection is supplied to one terminal of the piezoelectric element 60, the discharge unit 600 including the piezoelectric element 60 vibrates in the period T1 to generate residual vibration, but the ink is not discharged. In the present embodiment, the drive signal Vout corresponding to all of the "non-recording" is applied to the discharge units 600 which are not the inspection target.

6. Configuration of Selection Control Unit and Selection Unit

Figure 7:
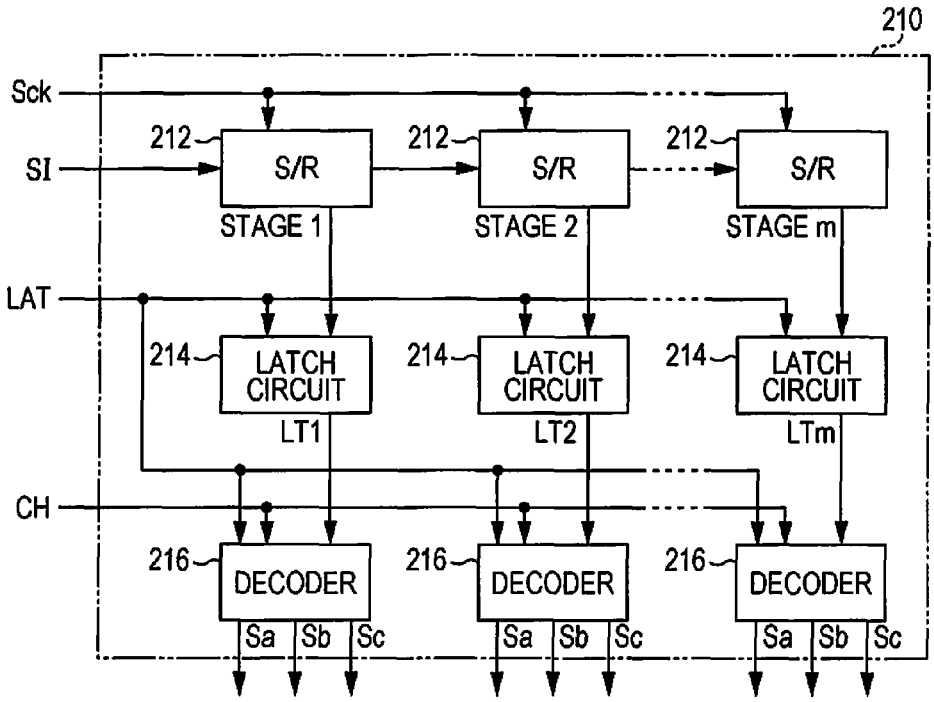
FIG. 7 is a diagram illustrating the configuration of a selection control unit in a head unit.

FIG. 7 is a diagram illustrating the configuration of the selection control unit 210 in FIG. 1. As illustrated in FIG. 7, the clock signal Sck, the print data signal SI, the latch signal LAT, and the change signal CH are supplied from the controller 10 to the selection control unit 210. In the selection control unit 210, a set of a shift register (S/R) 212, a latch circuit 214, and a decoder 216 is provided corresponding to each of the piezoelectric elements 60 (the nozzles 651).

The print data signal SI is a signal totaling 3m bits including 3 bit print data (SIH, SIM, and SIL) for selecting one of "large dot", "medium dot", "small dot", "non-recording", and "inspection" with respect to m discharge units 600.

The print data signal SI is serially supplied from the control signal reconstruction unit 320 in synchronization with the clock signal Sck. Corresponding to the nozzles, a configuration for temporarily holding 23 bits worth of the print data (SIH, SIM, SIL) which is included in the print data signal SI is the shift register 212.

Specifically, a configuration is adopted in which a number of stages of the shift registers 212 corresponding to the piezoelectric elements 60 (the nozzles) are cascade-connected to each other, and the print data signal SI which is serially supplied is sequentially transferred to the subsequent stage according to the clock signal Sck.

In order to discern the shift registers 212 when the number of the piezoelectric elements 60 is m (m is plural), the stages are denoted as stage 1, stage 2, . . . , stage m in order from the upstream side to which the print data signal SI is supplied.

Each of the m latch circuits 214 latches the 3 bit print data (SIH, SIM, and SIL) which is held by each of the m shift registers 212 at the leading edge of the latch signal LAT.

Each of the m decoders 216 decodes the 3 bit print data (SIH, SIM, and SIL) which is latched by each of the m latch circuits 214, outputs the selection signals Sa, Sb, and Sc for each of the periods T1 and T2 which are defined by the latch signal LAT and the change signal CH, and defines the selection by the selection unit 230.

Figures 8, 9:
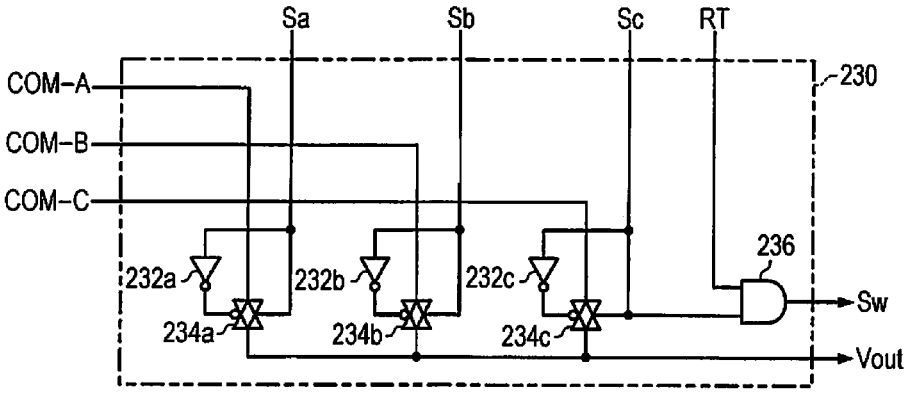
FIG. 8 is a diagram illustrating decoded content of a decoder in the head unit.
FIG. 9 is a diagram illustrating the configuration of a selection unit in the head unit.

FIG. 8 is a diagram illustrating the decoded content of the decoder 216. For example, if the latched 3 bit print data (SIH, SIM, and SIL) is (1, 0, 0), this means that in the period T1, the decoder 216 outputs the logic levels of the selection signals Sa, Sb, and Sc as H, L, and L levels, respectively, and in the period T2, the decoder 216 outputs the logic levels of the selection signals Sa, Sb, and Sc as L, H, and L levels, respectively.

With respect to the logic levels of the selection signals Sa, Sb, and Sc, the logic levels of the clock signal Sck, the print data signal SI, the latch signal LAT, and the change signal CH are shifted to a high amplitude logic level by a level shifter (not illustrated).

FIG. 9 is a diagram illustrating the configuration of the selection unit 230 corresponding to a single piezoelectric element 60 (the nozzle 651) in FIG. 1.

As shown in FIG. 9, the selection unit 230 includes inverters (NOT circuits) 232*a*, 232*b*, and 232*c*, the transfer gates 234*a*, 234*b*, 234*c*, and an AND circuit 236.

The selection signal Sa from the decoder 216 is supplied to the positive control terminal which is not marked with a circle at the transfer gate 234*a*, and is logically inverted by the inverter 232*a* to be supplied to the negative control terminal which is marked with a circle at the transfer gate 234*a*. Similarly, the selection signal Sb is supplied to the positive control terminal of the transfer gate 234*b*, and is logically inverted by the inverter 232*b* to be supplied to the negative control terminal of the transfer gate 234*b*. Similarly, the selection signal Sc is supplied to the positive control terminal of the transfer gate 234*c*, and is logically inverted by the inverter 232*c* to be supplied to the negative control terminal of the transfer gate 234*c*.

The drive signal COM-A is supplied to the input terminal of the transfer gate 234*a*, the drive signal COM-B is supplied to the input terminal of the transfer gate 234*b*, and the drive signal COM-C is supplied to the input terminal of the transfer gate 234*c*. The output terminals of the transfer gates 234*a*, 234*b*, and 234*c* are connected in common, and the drive signal Vout is output to the switching unit 340 via the common connection terminal.

If the selection signal Sa is at the H level, the transfer gate 234*a* allows conduction (ON) between the input terminal and the output terminal, and when the selection signal Sa is at the L level, the transfer gate 234*a* disallows conduction (OFF) between the input terminal and the output terminal. Similarly, the transfer gates 234*b* and 234*c* are turned on and off between the input terminal and the output terminal according to the selection signals Sb and Sc.

The AND circuit 236 outputs a signal representing the logical product of the selection signal Sc and the switching period specification signal RT to the switching unit 340 as the selection signal Sw.

Next, description will be given of the operations between the selection control unit 210 and the selection unit 230 with reference to FIG. 10.

The print data signal SI is serially supplied from the control signal reconstruction unit 320 for each nozzle in synchronization with the clock signal Sck, and is sequentially transferred in the shift register 212 corresponding to the nozzle. When the control signal reconstruction unit 320 stops the supplying of the clock signal Sck, each of the shift registers 212 enters a state of holding 3 bit print data (SIH, SIM, and SIL) corresponding to the nozzle. The print data signal SI is supplied in an order corresponding to the nozzles of the final stage m, . . . , stage 2, and stage 1 in the shift registers 212.

Here, at the leading edge of the latch signal LAT, the latch circuits 214 latch the 3-bit print data (SIH, SIM, and SIL) which is held in the shift registers 212 all at once. In FIG. 10, LT1, LT2, . . . , and LTm indicate the 3 bit print data (SIH, SIM, and SIL) which is latched by the latch circuits 214 corresponding to the shift registers 212 of stage 1, stage 2, . . . , and stage m.

The decoder 216 outputs the logic levels of the selection signals Sa, Sb, and Sc in each of the periods T1 and T2 according to the size of the dots which are defined by the latched 3 bit print data (SIH, SIM, and SIL) as the content illustrated in FIG. 8.

In other words, in a case in which the print data (SIH, SIM, and SIL) is (1, 1, 0) and defines the size of the large dot, the decoder 216 sets the selection signals Sa, Sb, and Sc to H, L, and L levels in the period T1, and sets the selection signals Sa, Sb, and Sc to H, L, and L levels in the period T2. In a case in which the print data (SIH, SIM, and SIL) is (1, 0, 0) and defines the size of the medium dot, the decoder 216 sets the selection signals Sa, Sb, and Sc to H, L, and L levels in the period T1, and sets the selection signals Sa, Sb, and Sc to L, H, and L levels in the period T2. In a case in which the print data (SIH, SIM, and SIL) is (0, 1, 0) and defines the size of the small dot, the decoder 216 sets the selection signals Sa, Sb, and Sc to L, L, and L levels in the period T1, and sets the selection signals Sa, Sb, and Sc to L, H, and L levels in the period T2. In a case in which the print data (SIH, SIM, and SIL) is (0, 0, 0) and defines non-recording, the decoder 216 sets the selection signals Sa, Sb, and Sc to L, H, and L levels in the period T1, and sets the selection signals Sa, Sb, and Sc to L, L, and L levels in the period T2. In a case in which the print data (SIH, SIM, and SIL) is (0, 0, 1) and defines inspection, the decoder 216 sets the selection signals Sa, Sb, and Sc to L, L, and H levels in the period T1, and sets the selection signals Sa, Sb, and Sc to L, L, and H levels in the period T2.

When the print data (SIH, SIM, and SIL) is (1, 1, 0), since the selection signals Sa, Sb, and Sc are at the H, L, and L levels in the period T1, the selection unit 230 selects the drive signal COM-A (the trapezoidal waveform Adp1), and since the selection signals Sa, Sb, and Sc are also at the H, L, and L levels in the period T2, the selection unit 230 selects the drive signal COM-A (the trapezoidal waveform Adp2). As a result, the drive signal Vout corresponding to "large dot" illustrated in FIG. 6 is generated.

When the print data (SIH, SIM, and SIL) is (1, 0, 0), since the selection signals Sa, Sb, and Sc are at the H, L, and L levels in the period T1, the selection unit 230 selects the drive signal COM-A (the trapezoidal waveform Adp1), and since the selection signals Sa, Sb, and Sc are also at the L, H, and L levels in the period T2, the selection unit 230 selects the drive signal COM-B (the trapezoidal waveform Bdp2). As a result, the drive signal Vout corresponding to "medium dot" illustrated in FIG. 6 is generated.

When the print data (SIH, SIM, and SIL) is (0, 1, 0), since the selection signals Sa, Sb, and Sc are at the L, L, and L levels in the period T1, the selection unit 230 selects none of the drive signals COM-A, COM-B, and COM-C, and since the selection signals Sa, Sb, and Sc are also at the L, H, and L levels in the period T2, the selection unit 230 selects the drive signal COM-B (the trapezoidal waveform Bdp2). As a result, the drive signal Vout corresponding to "small dot" illustrated in FIG. 6 is generated. Since none of the drive signals COM-A, COM-B, and COM-C are selected in the period T1, one terminal of the piezoelectric element 60 is open, and due to the capacitance of the piezoelectric element 60, the drive signal Vout is held at the voltage Vc directly preceding.

When the print data (SIH, SIM, and SIL) is (0, 0, 0), since the selection signals Sa, Sb, and Sc are at the L, H, and L levels in the period T1, the selection unit 230 selects the drive signal COM-B (the trapezoidal waveform Bdp1), and since the selection signals Sa, Sb, and Sc are at the L, L, and L levels in the period T2, the selection unit 230 selects none of the drive signals COM-A, COM-B, and COM-C. As a result, the drive signal Vout corresponding to "non-recording" illustrated in FIG. 6 is generated. Since none of the drive signals COM-A, COM-B, and COM-C are selected in the period T2, one terminal of the piezoelectric element 60 is open, and due to the capacitance of the piezoelectric element 60, the drive signal Vout is held at the voltage Vc directly preceding.

When the print data (SIH, SIM, and SIL) is (0, 0, 1), since the selection signals Sa, Sb, and Sc are at the L, L, and H levels in the period T1, the selection unit 230 selects the drive signal COM-C (the trapezoidal waveform Cdp1), and since the selection signals Sa, Sb, and Sc are also at the L, L, and H levels in the period T2, the selection unit 230 selects the drive signal COM-C (the fixed voltage Vc). As a result, the drive signal Vout corresponding to "inspection" illustrated in FIG. 6 is generated.

Figure 10:
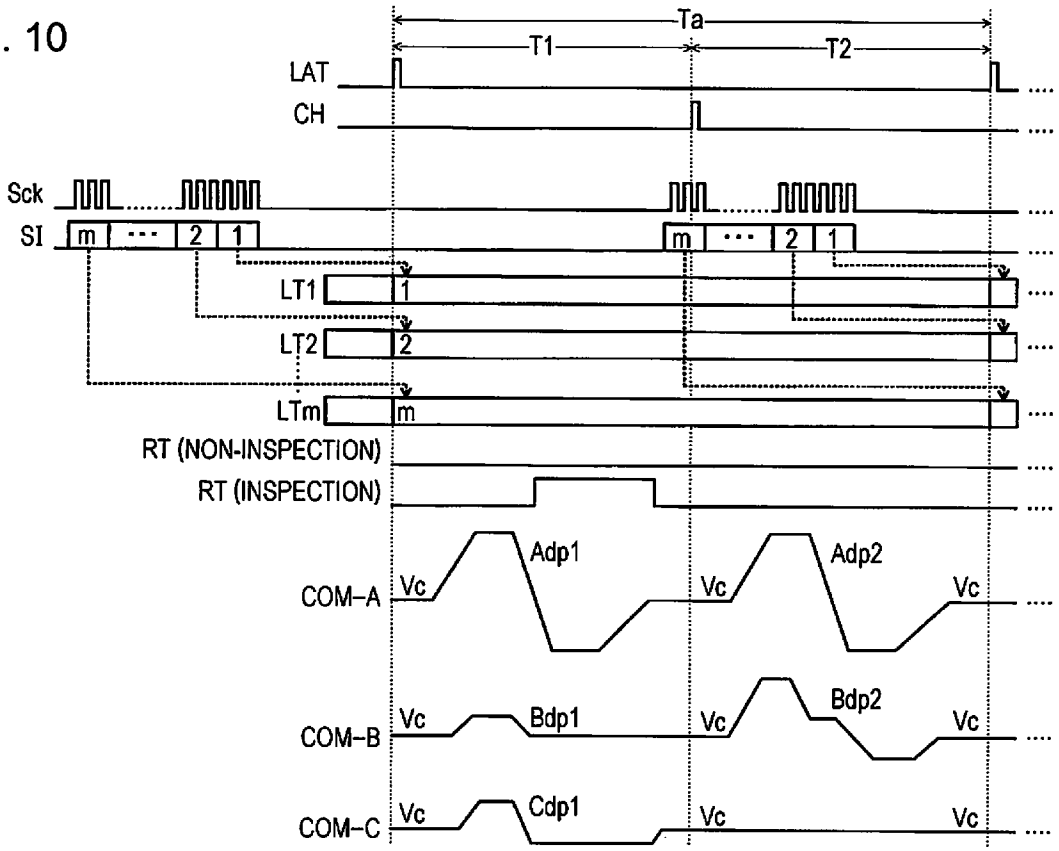
FIG. 10 is a diagram for explaining the operations of the selection control unit and the selection unit in the head unit.

The drive signals COM-A, COM-B and COM-C illustrated in FIGS. 5 and 10 are only examples. In actuality, various pre-prepared waveforms are combined and used according to the transport speed of the head unit 2, the properties of the printing medium, and the like.

Here, although description is given of an example in which the piezoelectric element 60 flexes upward with a rise in the voltage, if the voltage which is supplied to the electrodes 611 and 612 is inverted, the piezoelectric element 60 flexes downward with a rise in the voltage. Therefore, in a configuration in which the piezoelectric element 60 flexes downward with a rise in the voltage, the drive signals COM-A, COM-B, and COM-C which are exemplified in FIGS. 5 and 10 become waveforms which are inverted around the voltage Vc.

7. Configuration of Switching Unit

Figure 11:
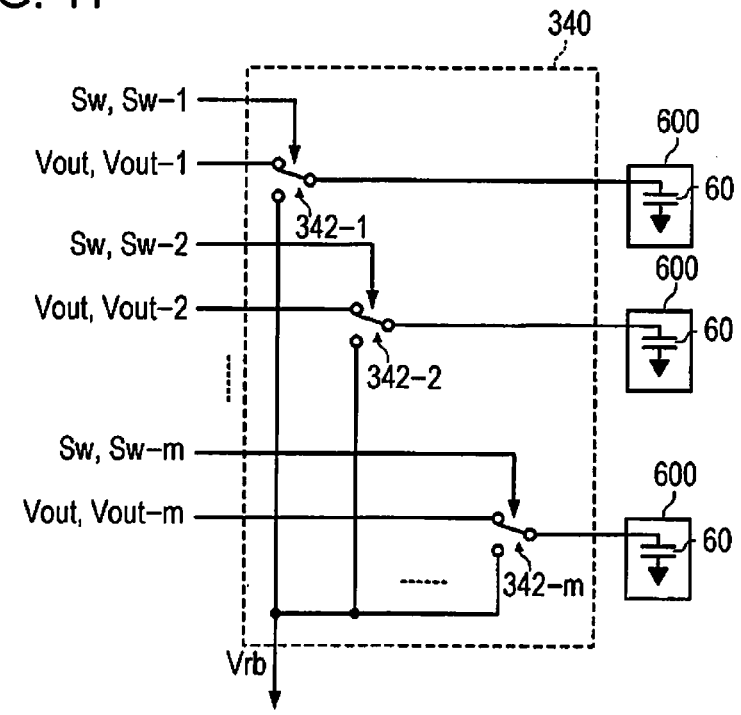
FIG. 11 is a diagram illustrating the configuration of a switching unit in the head unit.

FIG. 11 is a diagram illustrating the configuration of the switching unit 340. As illustrated in FIG. 11, the switching unit 340 includes m switches 342-1 to **342-*m* which are connected to one terminal of the piezoelectric elements 60 which are included in each of the m number of discharge units 600, and m switches 342-1 to 342-*m* are controlled by m selection signals Sw (Sw-1 to Sw-m) which are output from the m selection units 230, respectively. Specifically, the switch 342-*i* (where i is any one of l to m) applies the drive signal Vout-i to one terminal of the piezoelectric element 60 of the i-th discharge unit 600 when Sw-i is at the low level. The switch 342-*i* does not apply the drive signal Vout-i to one terminal of the piezoelectric element 60 which is included in the i-th discharge unit 600 when Sw-i is at the high level, and selects the signal which is generated at one terminal of the piezoelectric element 60 as the residual vibration signal Vrb. In the printing period, since the switching period specification signal RT is at the low level and all of the m selection signals Sw (Sw-1 to Sw-m) are at the low level, m discharge units 600 are supplied with the drive signals Vout (Vout-1 to Vout-m) which correspond to any one of "large dot", "medium dot", "small dot", and "non-recording". In the inspection period, when the selection signal Sw-i is at the low level (the switching period specification signal RT is at the low level), the i-th (where i is any one of 1 to m) discharge unit 600 to be the inspection target is supplied with the drive signal Vout-i corresponding to "inspection", and when the selection signal Sw-i is at the high level (the switching period specification signal RT is at the high level), the signal from the i-th discharge unit 600 is selected as the residual vibration signal Vrb. In the inspection period, another selection signal Sw-j (where j is any one of i to m excluding i) is at the low level, and the discharge unit 600** which is a non-inspection target is supplied with the drive signal corresponding to "non-recording".

Figure 12:
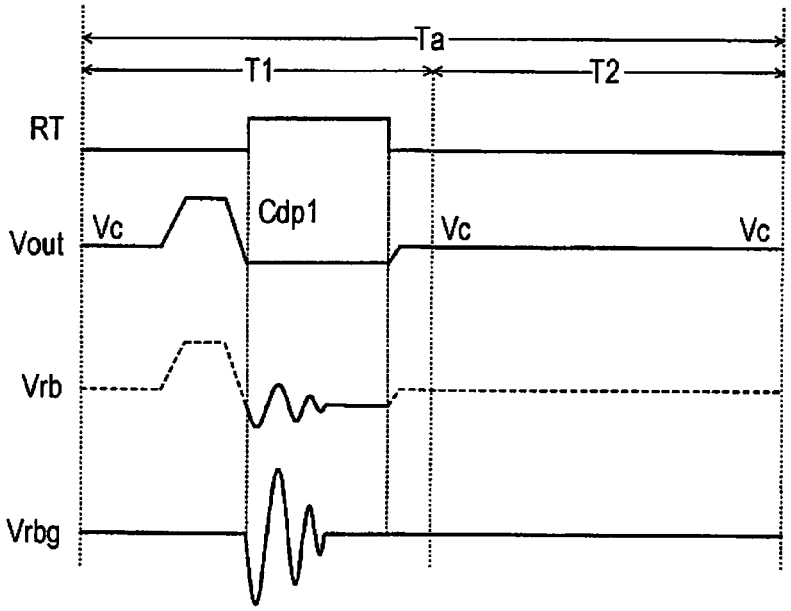
FIG. 12 is a diagram illustrating an example of waveforms in an inspection period of a switching period specification signal RT, a drive signal Vout which is applied to a discharge unit which is an inspection target, and a residual vibration signal Vrb.

FIG. 12 is a diagram illustrating an example of waveforms in an inspection period of the switching period specification signal RT, the drive signal Vout which is applied to the discharge unit 600 which is the inspection target, and the residual vibration signal Vrb. In FIG. 12, the waveform of the residual vibration signal Vrbg which is output from the amplification unit 350 (refer to FIG. 1) is also illustrated. As illustrated in FIG. 12, when the switching period specification signal RT is at the low level, the drive signal Vout (the drive signal COM-C for inspection) is applied to the discharge unit 600 which is the inspection target. When the switching period specification signal RT is at the high level, the drive signal Vout is not applied to the discharge unit 600 which is the inspection target, and the waveform due to the residual vibration after the drive signal Vout is applied to the discharge unit 600 manifests in the residual vibration signal Vrb. The residual vibration signal Vrb is amplified by the amplification unit 350 to become the residual vibration signal Vrbg, and the residual vibration signal Vrbg is transmitted to the controller 10 in an analog format by a transmission state signal transmission unit.

8. Operations and Effects of Liquid Discharging Apparatus

In the liquid discharging apparatus 1 according to the present embodiment described above, the controller 10 transmits a plurality of types of original control signal (the original clock signal sSck, the original print data signal sSI, the original latch signal sLAT, the original change signal sCH, and the original switching period specification signal sRT) to the head unit 2 as a differential signal which is not susceptible to the influence of common mode noise and is capable of low amplitude and high speed transfer. In other words, according to the liquid discharging apparatus 1 of the present embodiment, since it is possible to transfer a signal for controlling the discharging of the liquid from the discharge units 600 from the controller 10 to the head unit 2 at high speed, even if the number of the discharge units 600 (the number of nozzles) is large in the head unit 2, it is possible to perform the printing process at high speed.

According to the liquid discharging apparatus 1 of the present embodiment, by determining the presence or absence of discharge faults in the discharge units 600 based on the residual vibration signal Vrbg indicating the residual vibration of the discharge units 600 which is transmitted from the head unit 2, and performing the appropriate processes based on the determination results, the controller 10 is capable of suppressing the reduction in the discharge accuracy of the liquid from the discharge units 600.

When the temperature of the head unit 2 changes, the discharge characteristics of the discharge units 600 change, which influences the discharge accuracy of the liquid from the discharge units 600; however, according to the liquid discharging apparatus 1 of the present embodiment, the controller 10 is capable of suppressing the reduction in the discharge accuracy by accurately determining the state of the head unit 2 based on the temperature signal Vtemp indicating the temperature of the head unit 2 which is transmitted from the head unit 2, and performing the appropriate processes based on the determination results. In particular, the drive circuits 50-*a*, 50-*b*, and 50-*c* for generating the drive signals COM-A, COM-B, and COM-C which have high voltages (for example, approximately several ten V) have high power consumption and easily become a high temperature, and when the drive waveforms of the drive signals COM-A, COM-B, and COM-C change in accordance with the temperature characteristics of the drive circuits 50-*a*, 50-*b*, 50-*c*, the discharge accuracy of the liquid from the discharge units 600 is influenced. Therefore, according to the liquid discharging apparatus 1 of the present embodiment, the head unit 2 generates the temperature signal Vtemp indicating the temperature of the drive circuits 50-*a*, 50-*b*, and 50-*c*, and the controller 10 is capable of suppressing a reduction in the discharge accuracy of the liquid from the discharge units 600 by accurately determining the state of the head unit 2 based on the temperature signal Vtemp.

In the liquid discharging apparatus 1 according to the present embodiment, the controller 10 transmits the original drive data sdA, sdB, and sdC to the head unit 2, and the drive circuits 50-*a*, 50-*b*, and 50-*c* which are provided in the head unit 2 respectively generate the drive signals COM-A, COM-B, and COM-C for driving the discharge units 600 based on the drive data dA, dB, and dC. In other words, according to the liquid discharging apparatus 1 according to the present embodiment, since the controller 10 does not transmit the drive signals COM-A, COM-B, and COM-C themselves which drive the discharge units 600 to the head unit 2, distortion (such as overshoot) of the drive waveform due to the drive signals COM-A, COM-B, and COM-C being transferred via the long flexible flat cable 190 does not occur, and it is possible to increase the discharge accuracy.

9. Modification Examples

In the above embodiment, the control signal transmission unit 120 of the controller 10 transmits the differential signals of each item of the original drive data sdA, sdB, and sdC; however, the original drive data sdA, sdB, and sdC may each be transmitted as a single end signal.

In the above embodiment, the controller 10 and the head unit 2 are connected by the single flexible flat cable 190; however, the controller 10 and the head unit 2 may be connected by a plurality of flexible flat cables. For example, the signal lines 191*a* and 191*b* to which the differential signals which are output from the control signal transmission unit 120 are transmitted, and the signal lines 193*a*, 193*b*, 193*c*, 193*d*, 193*e*, and 193*f* to which differential signals which are output from the drive data transmission unit 140 are transmitted may be provided on different flexible flat cables. Various signals are transmitted from the controller 10 to the head unit 2 by cable; however the various signals may be transmitted wirelessly. In other words, the controller 10 and the head unit 2 may not be connected by the flexible flat cable 190.

In the above embodiment, the state signal generation unit 380 of the head unit 2 generates both the residual vibration signal Vrbg and the temperature signal Vtemp as the state signals indicating the state of the head unit 2; however, only one of the residual vibration signal Vrbg and the temperature signal Vtemp may be generated.

In the above embodiment, the drive circuits 50-*a*, 50-*b* and 50-*c* are provided in the head unit 2; however, the drive circuits 50-*a*, 50-*b* and 50-*c* may be provided in the controller 10. In this case, the controller 10 may transmit the drive signals COM-A, COM-B, and COM-C which are output from the drive circuits 50-*a*, 50-*b*, and 50-*c* to the head unit 2 via the flexible flat cable 190.

The liquid discharging apparatus 1 according to the above embodiment may be a large format printer. For example, a large format printer is a printer in which the maximum size of printable medium is greater than or equal to A2 size paper (420 mm×594 mm). In the large format printer, the number of the nozzles 651 is increased in order to realize high speed printing and high fidelity printing, and as a result, the number of bits of the original print data signal sSI (the print data signal SI) increases; however, by performing the high speed data transfer, it is possible to suppress a reduction in the printing speed.

In the above embodiment, the piezoelectric element which discharges the ink is described as an example of the drive target of the drive circuit; however, the drive target is not limited to the piezoelectric element, and for example, the drive target may be a capacitive load such as an ultrasonic motor, a touch panel, a flat speaker, or a liquid crystal display. In other words, the drive circuit may drive a capacitive load.

Hereinabove, description is given of the present embodiment or modification examples; however, the present invention is not limited to the present embodiment or the modification examples, and can be implemented in various modes without departing from the gist thereof. For example, the above embodiment and the modification examples can be combined as appropriate.

The invention includes configurations which are the substantially the same as the configurations described in the embodiment (for example, configurations having the same function, method and results, or configurations having the same object and effect). The invention includes configurations in which non-essential portions of the configurations described in the embodiment are replaced. The invention includes configurations exhibiting the same operation and effect as the configurations described in the embodiment, or configurations capable of achieving the same object. The invention includes configurations in which known techniques are added to the configurations described in the embodiment.

CROSS-REFERENCE TO RELATED APPLICATION

The entire disclosure of Japanese Patent Application No. 2016-134374, filed Jul. 6, 2016 is expressly incorporated by reference herein.

What is claimed is:

1. A liquid discharging apparatus comprising:

a head unit which includes a discharge unit which discharges a liquid;

a controller which controls discharging of the liquid;

a plurality of first signal lines which connect the controller to the head unit; and at least one second signal line which connects the controller to the head unit, wherein, the controller includes a control signal generation unit which generates a plurality of types of original control signal for controlling discharging of the liquid, a control signal conversion unit which converts the plurality of types of original control signal into one serial format serial control signal, a control signal transmission unit which converts the serial control signal into a differential signal, and transmitting the differential signal to the head unit via the first signal lines, a state signal reception unit which receiving a state signal indicating a state of the head unit which is transmitted from the head unit via the second signal line, and a state determination unit which determines a state of the discharge unit based on the state signal which is received, and wherein the head unit includes a control signal reception unit which receives the differential signal which is transmitted from the controller via the first signal lines and converting the differential signal which is received into the serial control signal, a control signal reconstruction unit which generates a plurality of types of control signal for controlling discharging of the liquid based on the serial control signal which is converted by the control signal reception unit, a state signal generation unit which detects a state of the head unit to generate the state signal, and a state signal transmission unit which transmits the state signal in analog format to the controller via the second signal line.

2. The liquid discharging apparatus according to claim 1, wherein the discharge unit is driven based on a drive signal, and wherein the state signal generation unit detects residual vibration of the discharge unit after the discharge unit is driven, and generates a residual vibration signal indicating the residual vibration as one of the state signals.

3. The liquid discharging apparatus according to claim 1, wherein the state signal generation unit detects a temperature of the head unit, and generates a temperature signal indicating the temperature as one of the state signals.

4. The liquid discharging apparatus according to claim 1, further comprising:

a third signal line, wherein the controller further includes a drive data generation unit which generates original drive data which is data indicating a drive signal for driving the discharge unit, and a drive data transmission unit which transmits the original drive data to the head unit via the third signal line, and wherein the head unit further includes a drive data reception unit which receives the original drive data which is transmitted from the controller, and outputting drive data which is data indicating the drive signal, and a drive circuit which generates the drive signal based on the drive data.

5. The liquid discharging apparatus according to claim 1, further comprising:

a third signal line, wherein the controller further includes a drive data generation unit which generates original drive data which is data indicating a drive signal for driving the discharge unit, and a drive data transmission unit which transmits the original drive data to the head unit via the third signal line, wherein the head unit further includes a drive data reception unit which receives the original drive data which is transmitted from the controller, and outputting drive data which is data indicating the drive signal, and a drive circuit which generates the drive signal based on the drive data, and wherein the state signal generation unit detects a temperature of the drive circuit and generates a temperature signal indicating the temperature as one of the state signals.

6. A controller which is connected by a plurality of first signal lines and at least one second signal line to a head unit including a discharge unit which discharges a liquid, the controller comprising:

a control signal generation unit which generates a plurality of types of original control signal for controlling discharging of the liquid;

a control signal conversion unit which converts the plurality of types of original control signal into one serial format serial control signal;

a control signal transmission unit which converts the serial control signal into a differential signal, and transmitting the differential signal to the head unit via the first signal lines;

a state signal reception unit which receives a state signal indicating a state of the head unit which is transmitted in analog format from the head unit via the second signal line; and a state determination unit which determines a state of the discharge unit based on the state signal which is received.

7. A head unit which is connected by a plurality of first signal lines and at least one second signal line to a controller, the head unit comprising:

a discharge unit which discharges a liquid;

a control signal reception unit which receives a differential signal which is transmitted from the controller via the first signal lines and converting the differential signal which is received into one serial format serial control signal;

a control signal reconstruction unit which generates a plurality of types of control signal for controlling discharging of the liquid based on the serial control signal which is converted by the control signal reception unit;

a state signal generation unit which detects a state of the head unit to generate a state signal indicating the state of the head unit; and a state signal transmission unit which transmits the state signal in analog format to the controller via the second signal line.

* * * * *